US009931662B2

(12) United States Patent
Chiang

(10) Patent No.: US 9,931,662 B2
(45) Date of Patent: Apr. 3, 2018

(54) METHOD FOR QUICKLY REPLACING AN AIR OUTLET PIPE OF AN AIR BLOW GUN

(71) Applicant: Kuo-Chin Chiang, Taichung (TW)

(72) Inventor: Kuo-Chin Chiang, Taichung (TW)

( * ) Notice: Subject to any disclaimer, the term of this patent is extended or adjusted under 35 U.S.C. 154(b) by 155 days.

(21) Appl. No.: 15/186,589

(22) Filed: Jun. 20, 2016

(65) Prior Publication Data

US 2017/0361348 A1 Dec. 21, 2017

(51) Int. Cl.

| | |
|---|---|
| ***B05B 15/06*** | (2006.01) |
| ***B05B 1/00*** | (2006.01) |
| ***B05B 9/01*** | (2006.01) |
| ***B05B 12/00*** | (2018.01) |

(52) U.S. Cl.

CPC ..... *B05B 15/065* (2013.01); *B05B 1/005* (2013.01); *B05B 9/01* (2013.01); *B05B 12/002* (2013.01)

(58) Field of Classification Search

CPC ..... B05B 15/065; B05B 12/002; B05B 1/005; B05B 9/01

See application file for complete search history.

(56) References Cited

U.S. PATENT DOCUMENTS

| | | | | |
|---|---|---|---|---|
| 4,010,902 A * | 3/1977 | Speyer | B05B 1/005 | 124/73 |
| 6,698,672 B1 * | 3/2004 | Linkletter | B05B 1/005 | 239/280 |
| 8,757,669 B2 * | 6/2014 | Chou | F16L 19/065 | 285/298 |
| 2011/0220741 A1 * | 9/2011 | Wang | B05B 1/308 | 239/589 |

* cited by examiner

*Primary Examiner* — Ryan J Walters
(74) *Attorney, Agent, or Firm* — Alan D. Kamrath; Kamrath IP Lawfirm, P.A.

(57) ABSTRACT

A method for quickly replacing an air outlet pipe of an air blow gun includes providing a gun body, a C-shaped clamping ring, a rotation knob and a nozzle head, and rotating the rotation knob to rotate the clamping ring, moving the oblique guide faces of each of the clamping jaws of the clamping ring to touch the resting portions of each of the arcuate slots of the mounting head of the gun body, pressing outward each of the clamping jaws of the clamping ring, releasing the clamping jaws of the clamping ring from the locking groove of the nozzle head, detaching the nozzle head from the clamping ring, and detaching the nozzle head from the mounting head of the gun body. Thus, the nozzle head is detached from the gun body quickly.

6 Claims, 10 Drawing Sheets

S - S

S - S

F-F

C-C

E - E

METHOD FOR QUICKLY REPLACING AN AIR OUTLET PIPE OF AN AIR BLOW GUN

BACKGROUND OF THE INVENTION

1. Field of the Invention

The present invention relates to an air blow gun and, more particularly, to a method for quickly replacing an air outlet pipe of an air blow gun.

2. Description of the Related Art

A conventional air blow gun comprises a gun body and a nozzle head removably mounted on the gun body. The gun body has an air outlet provided with a mounting head. The nozzle head has a front portion provided with an air outlet pipe and a rear portion provided with a connecting portion connected with the mounting head of the gun body. The connecting portion of the nozzle head is combined with the mounting head of the gun body by engagement of an external thread and an internal thread. However, the nozzle head cannot be mounted on and detached from the gun body quickly and conveniently, thereby causing inconvenience to the operator in replacement of the air outlet pipe of the nozzle head.

BRIEF SUMMARY OF THE INVENTION

The primary objective of the present invention is to provide a method for replacing an air outlet pipe of an air blow gun easily and quickly.

In accordance with the present invention, there is provided a method for quickly replacing an air outlet pipe of an air blow gun, comprising providing a gun body, a clamping ring, a rotation knob, and a nozzle head. The gun body has an air outlet provided with a mounting head. The nozzle head is inserted into the mounting head of the gun body. The clamping ring is mounted on the mounting head of the gun body. The rotation knob is mounted on the clamping ring. The mounting head has a periphery provided with two arcuate slots. Each of the two arcuate slots is provided with two ramps forming two acute resting portions. The clamping ring has a substantially C-shaped profile. The clamping ring has a periphery provided with two substantially inverted U-shaped slits forming two elastic plates. The two elastic plates form two clamping jaws respectively extending into the two arcuate slots of the mounting head. Each of the clamping jaws is provided with two oblique guide faces corresponding to the two resting portions of each of the two arcuate slots. When the two oblique guide faces of each of the clamping jaws touch the two resting portions of each of the two arcuate slots, each of the clamping jaws is pressed outward. The nozzle head has a front portion provided with an air outlet pipe. The nozzle head is provided with an annular locking groove corresponding to the clamping jaws of the clamping ring. The clamping jaws of the clamping ring are locked in the locking groove of the nozzle head by an elastic force of the two elastic plates. The method further comprises rotating the rotation knob to rotate the clamping ring, moving the two oblique guide faces of each of the clamping jaws of the clamping ring to touch the two resting portions of each of the two arcuate slots of the mounting head of the gun body, pressing outward each of the clamping jaws of the clamping ring, releasing the clamping jaws of the clamping ring from the locking groove of the nozzle head, detaching the nozzle head from the clamping ring, and detaching the nozzle head from the mounting head of the gun body.

Preferably, the rotation knob together with the clamping ring is rotatable relative to the mounting head of the gun body through an angle of thirty degrees (30°) in a positive or reverse direction.

Preferably, the air outlet pipe of the nozzle head has different sizes and kinds.

Preferably, the mounting head has an interior provided with at least three first engaging portions, and the nozzle head has a rear portion provided with at least three second engaging portions engaging the at least three first engaging portions of the gun body so that the nozzle head is combined with the mounting head of the gun body.

Preferably, the at least three first engaging portions of the mounting head of the gun body form a hexagonal hole for mounting the nozzle head, and the at least three second engaging portions of the nozzle head form a hexagonal head.

Alternatively, the at least three first engaging portions of the mounting head of the gun body form a plurality of inner ratchet teeth, and the at least three second engaging portions of the nozzle head form a plurality of outer ratchet teeth.

According to the primary advantage of the present invention, the nozzle head is unlocked from the clamping ring by rotating the rotation knob so that the nozzle head is detached from the mounting head of the gun body easily and quickly, thereby facilitating a user replacing the air outlet pipe.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
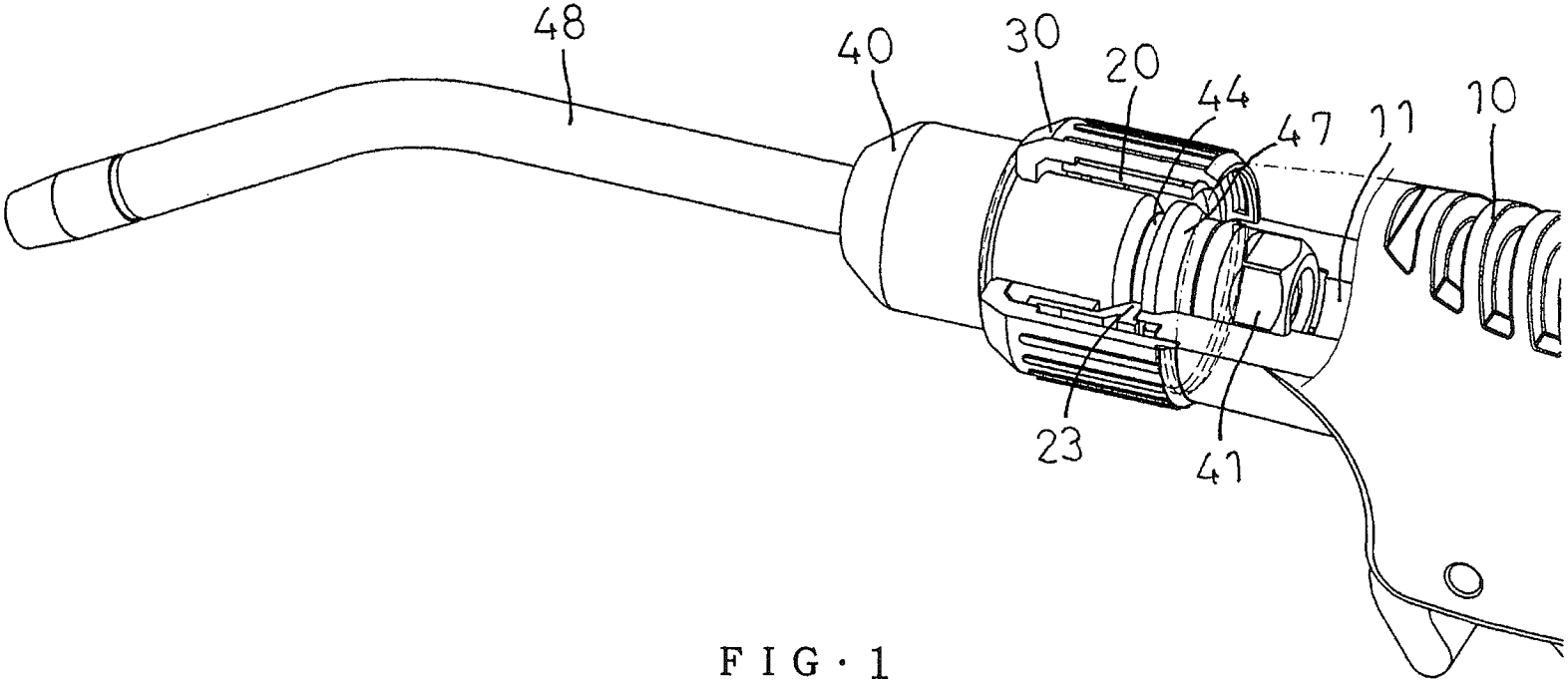
FIG. 1 is a perspective view of an air blow gun in accordance with the preferred embodiment of the present invention.
Figure 2:
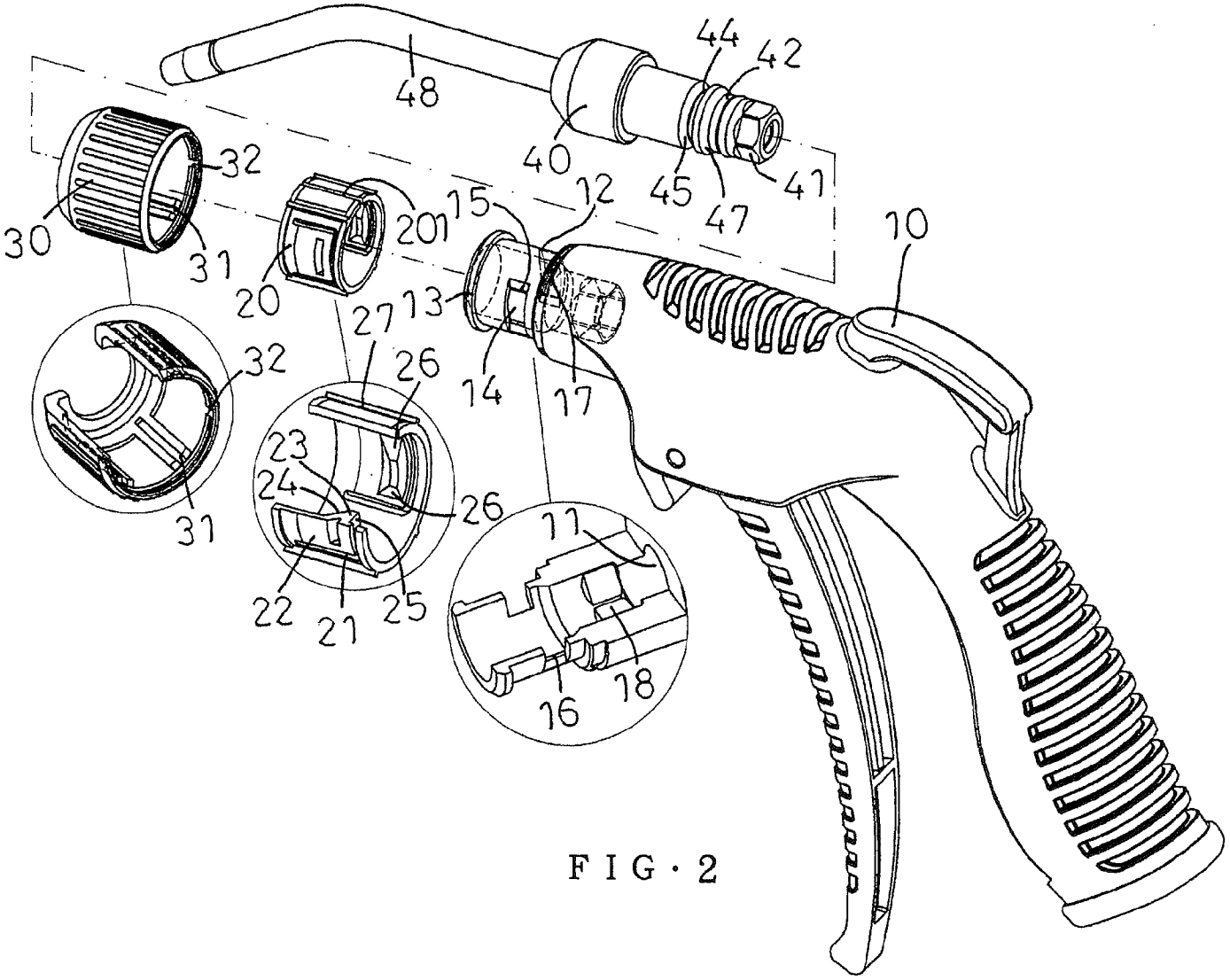
FIG. 2 is an exploded perspective view of the air blow gun in accordance with the preferred embodiment of the present invention.
Figure 3:
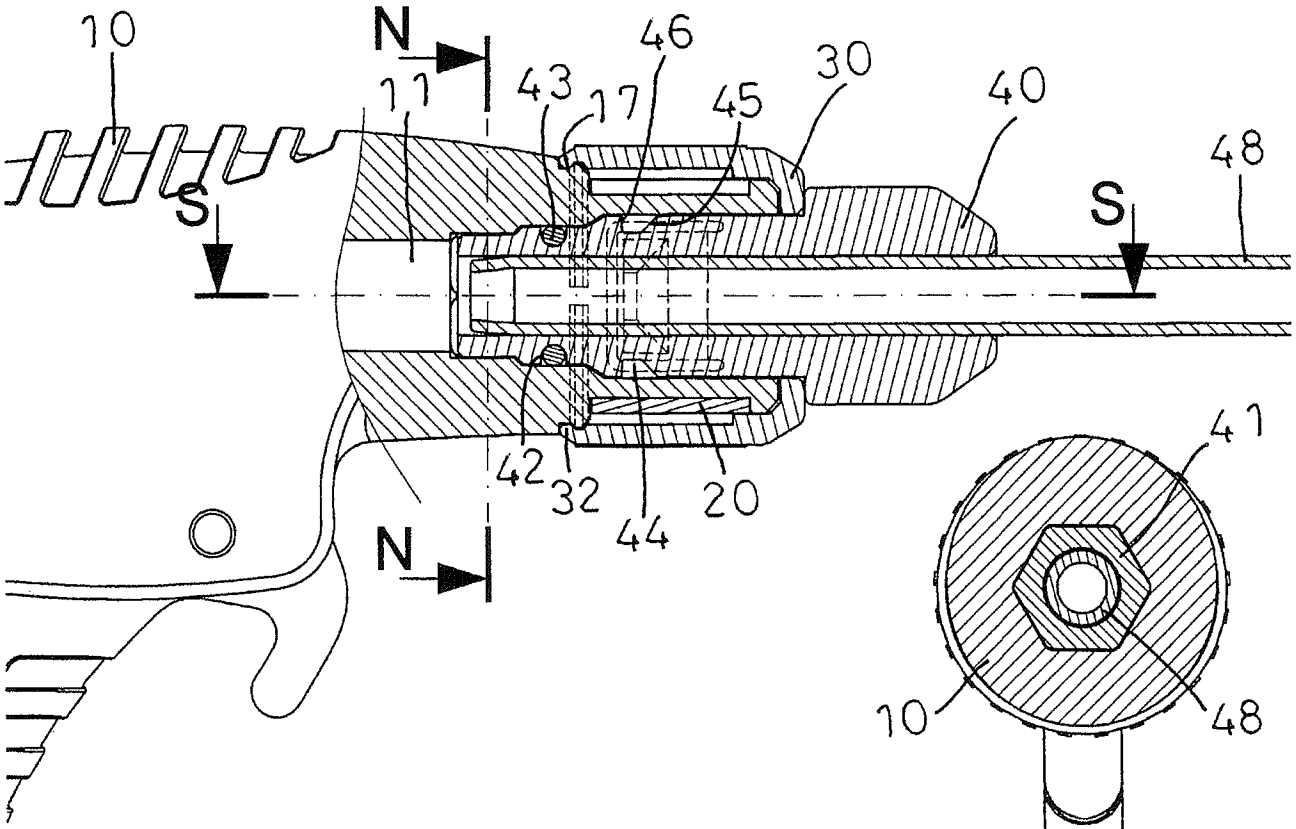
FIG. 3 is a cross-sectional view of the air blow gun in accordance with the preferred embodiment of the present invention.
Figure 4:
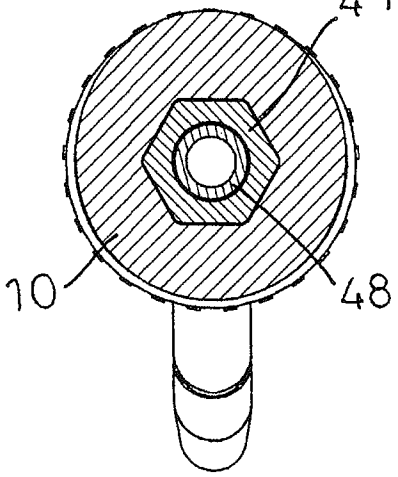
FIG. 4 is a top planar cross-sectional assembly view of the air blow gun taken along line N-N as shown in FIG. 3.
Figure 5:
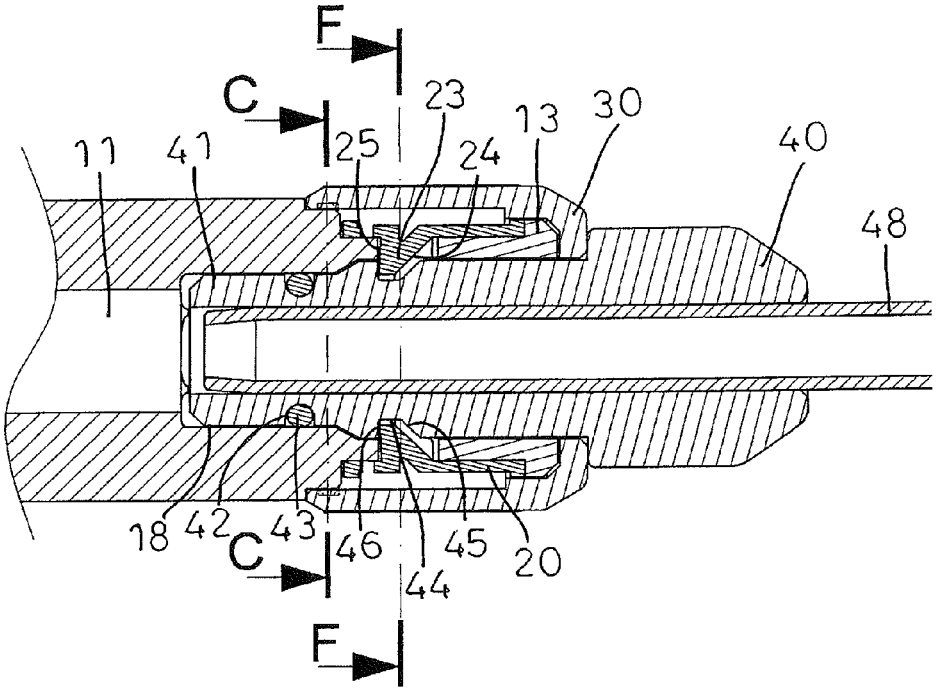
FIG. 5 is a top planar cross-sectional assembly view of the air blow gun taken along line S-S as shown in FIG. 3.
Figure 7:
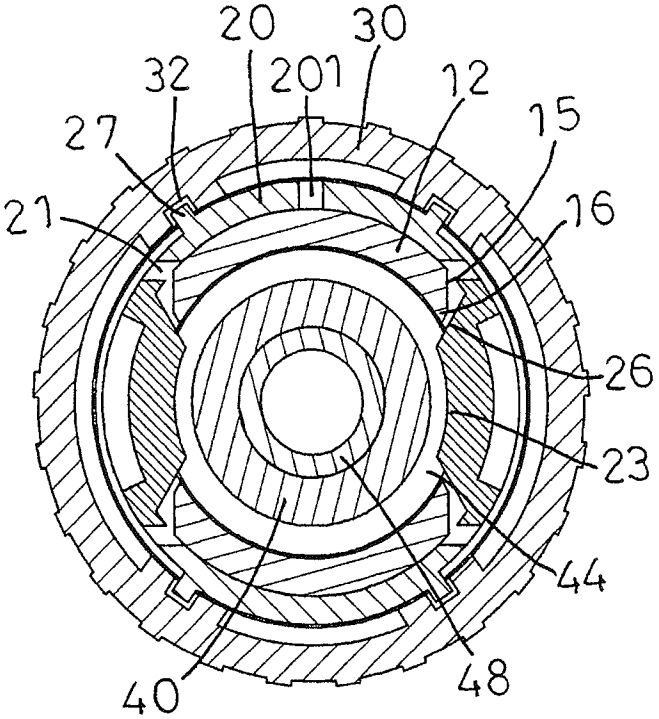
FIG. 7 is a top planar cross-sectional assembly view of the air blow gun taken along line F-F as shown in FIG. 5.
Figure 6:
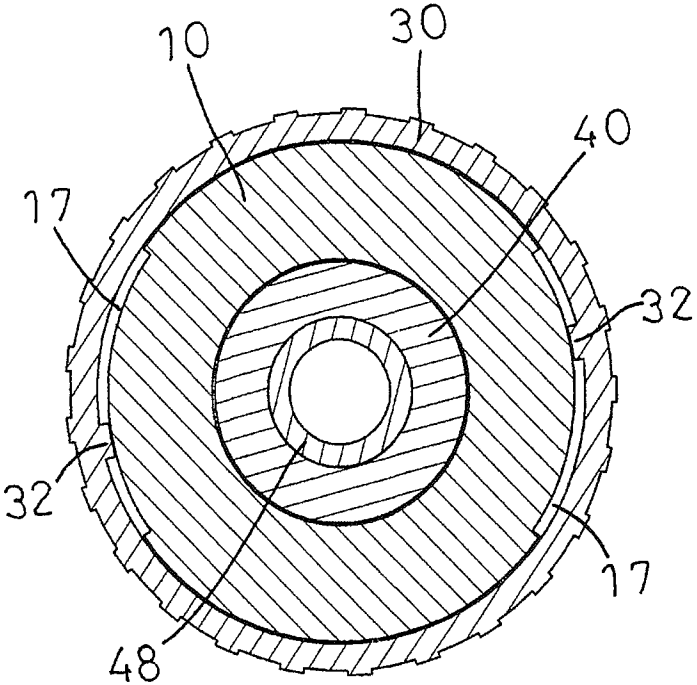
FIG. 6 is a top planar cross-sectional assembly view of the air blow gun taken along line C-C as shown in FIG. 5.

Referring to the drawings and initially to FIGS. 1-7, an air blow gun in accordance with the preferred embodiment of the present invention comprises a gun body 10, a clamping ring 20, a rotation knob 30, and a nozzle head 40.

The gun body 10 has an air outlet 11 provided with a mounting head 12. The mounting head 12 has a front portion provided with an annular flange 13. The mounting head 12 has a mediate portion having a periphery provided with two arcuate slots 14 which are arranged symmetrically. Each of the two arcuate slots 14 is provided with two ramps 15 forming two acute resting portions 16. The mounting head 12 has a rear portion provided with two positioning grooves 17 for limiting a rotation angle of the rotation knob 30. The mounting head 12 has an interior provided with at least three first engaging portions 18. In the preferred embodiment of the present invention, the at least three first engaging portions 18 of the mounting head 12 of the gun body 10 form a hexagonal hole for mounting the nozzle head 40.

The clamping ring 20 has a substantially C-shaped profile and is provided with an opening 201. The clamping ring 20 is originally expanded outward and then mounted on the mounting head 12 of the gun body 10. The clamping ring 20 has a periphery provided with two substantially inverted U-shaped slits 21 forming two elastic plates 22. The two elastic plates 22 form two inwardly protruding clamping jaws 23 respectively extending into the two arcuate slots 14 of the mounting head 12. Each of the clamping jaws 23 of the clamping ring 20 has a front portion provided with a first oblique guide face 24 and a rear portion provided with a vertical face 25. Each of the clamping jaws 23 is provided with two second oblique guide faces 26 corresponding to the two resting portions 16 of each of the two arcuate slots 14. When the two second oblique guide faces 26 of each of the clamping jaws 23 touch and press the two resting portions 16 of each of the two arcuate slots 14, each of the clamping jaws 23 is pressed outward, and the clamping ring 20 is expanded outward. The clamping ring 20 has an outer wall provided with a plurality of elongate ribs 27 each extending axially.

The rotation knob 30 is mounted on the clamping ring 20 and has an interior provided with a plurality of elongate channels 31 mounted on the elongate ribs 27 of the clamping ring 20 so that the rotation knob 30 is combined with the clamping ring 20. The rotation knob 30 has a rear portion provided with two positioning protrusions 32 slidably mounted in the two positioning grooves 17 of the mounting head 12. Thus, the rotation knob 30 is rotatable relative to the mounting head 12 of the gun body 10 through an angle of thirty degrees (30°) in the positive or reverse direction by engagement between the two positioning protrusions 32 of the rotation knob 30 and the two positioning grooves 17 of the mounting head 12.

The nozzle head 40 has a front portion provided with an air outlet pipe 48. The nozzle head 40 has a rear portion provided with at least three second engaging portions 41 engaging the at least three first engaging portions 18 of the gun body 10 so that the nozzle head 40 is combined with the mounting head 12 of the gun body 10. In the preferred embodiment of the present invention, the at least three second engaging portions 41 of the nozzle head 40 form a hexagonal head. The rear portion of the nozzle head 40 is further provided with an annular retaining groove 42 for mounting an O-ring 43 to provide an air-tight effect. The nozzle head 40 is provided with an annular locking groove 44 corresponding to the clamping jaws 23 of the clamping ring 20. The locking groove 44 of the nozzle head 40 has a shape the same as that of each of the clamping jaws 23 and has a front portion provided with an inclined face 45 and a rear portion provided with a vertical face 46. The nozzle head 40 is further provided with a third oblique guide face 47 located behind the locking groove 44. In assembly, the nozzle head 40 is inserted into the mounting head 12 of the gun body 10. When the third oblique guide face 47 of the nozzle head 40 touches and presses the first oblique guide face 24 of each of the clamping jaws 23 of the clamping ring 20, the clamping jaws 23 of the clamping ring 20 are pressed outward, so that the clamping ring 20 is expanded outward to allow passage of the nozzle head 40. When the third oblique guide face 47 of the nozzle head 40 passes through the first oblique guide face 24 of each of the clamping jaws 23 of the clamping ring 20, the clamping ring 20 is contracted inward by the elastic force of the two elastic plates 22, so that the clamping jaws 23 of the clamping ring 20 are moved inward and locked in the locking groove 44 of the nozzle head 40. At this time, the inclined face 45 of the nozzle head 40 corresponds to the first oblique guide face 24 of each of the clamping jaws 23, and the vertical face 46 of the nozzle head 40 corresponds to the vertical face 25 of each of the clamping jaws 23.

Figure 8:
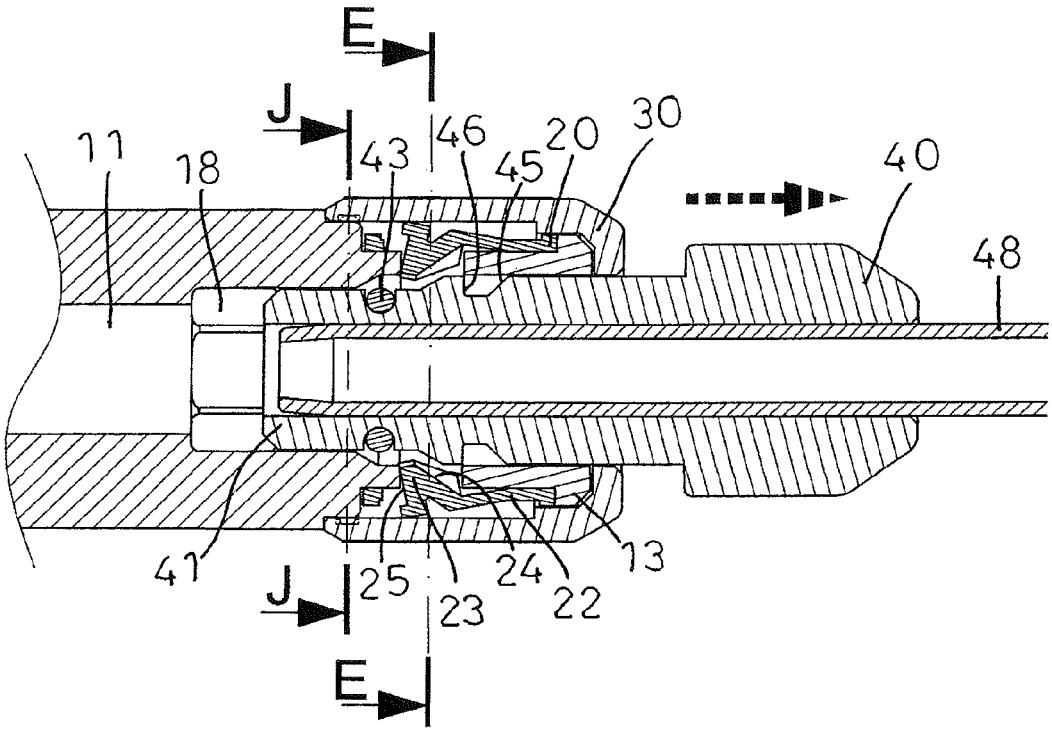
FIG. 8 is a schematic operational view of the air blow gun as shown in FIG. 5.
Figure 9:
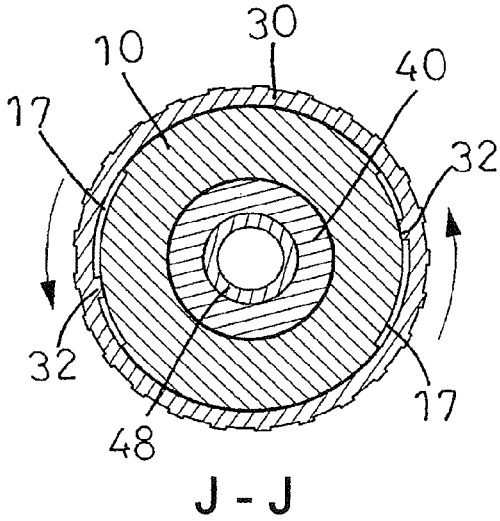
FIG. 9 is a top planar cross-sectional assembly view of the air blow gun taken along line J-J as shown in FIG. 8.
Figure 10:
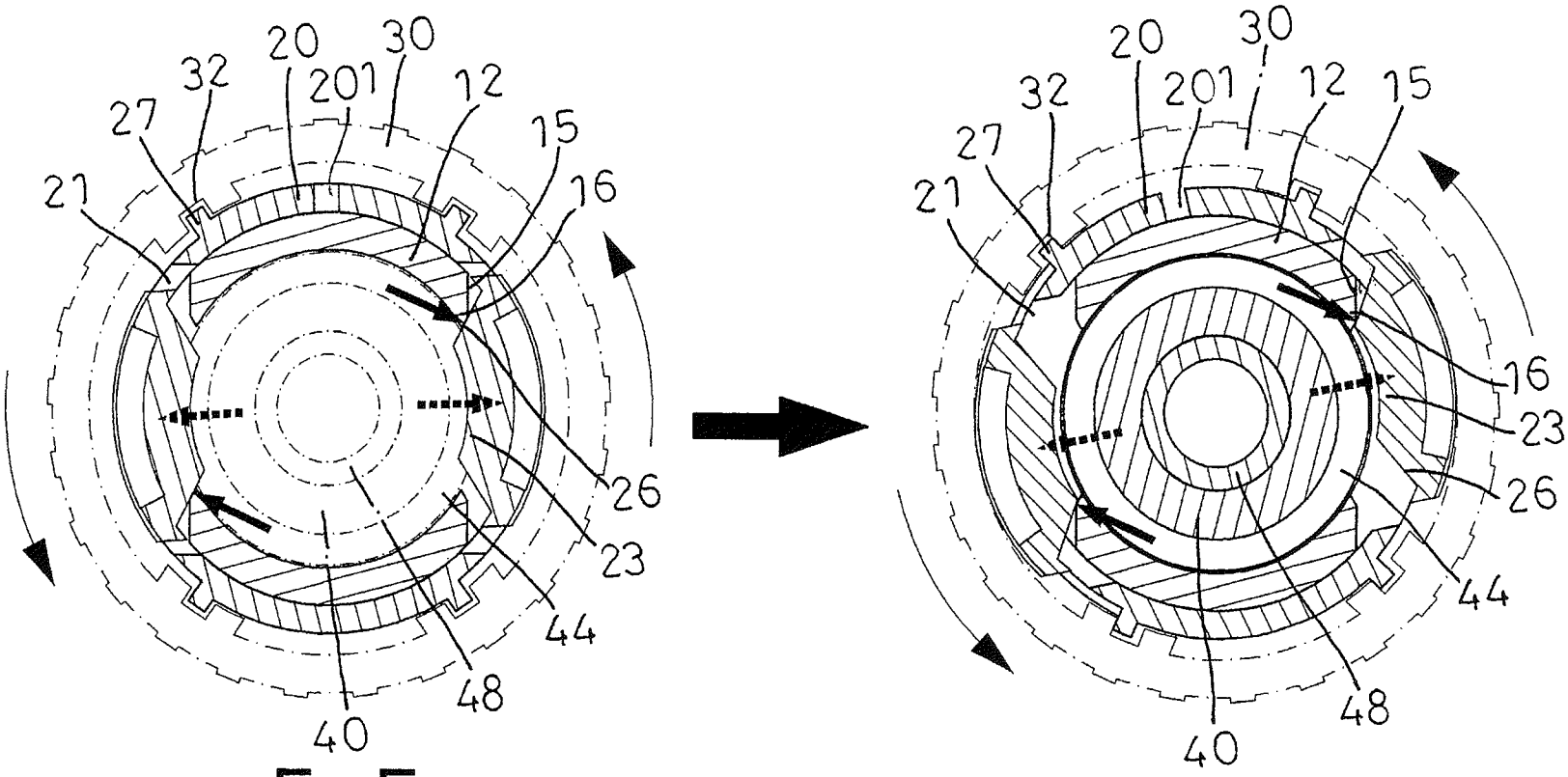
FIG. 10 is a top planar cross-sectional assembly view of the air blow gun taken along line E-E as shown in FIG. 8.
Figure 11:
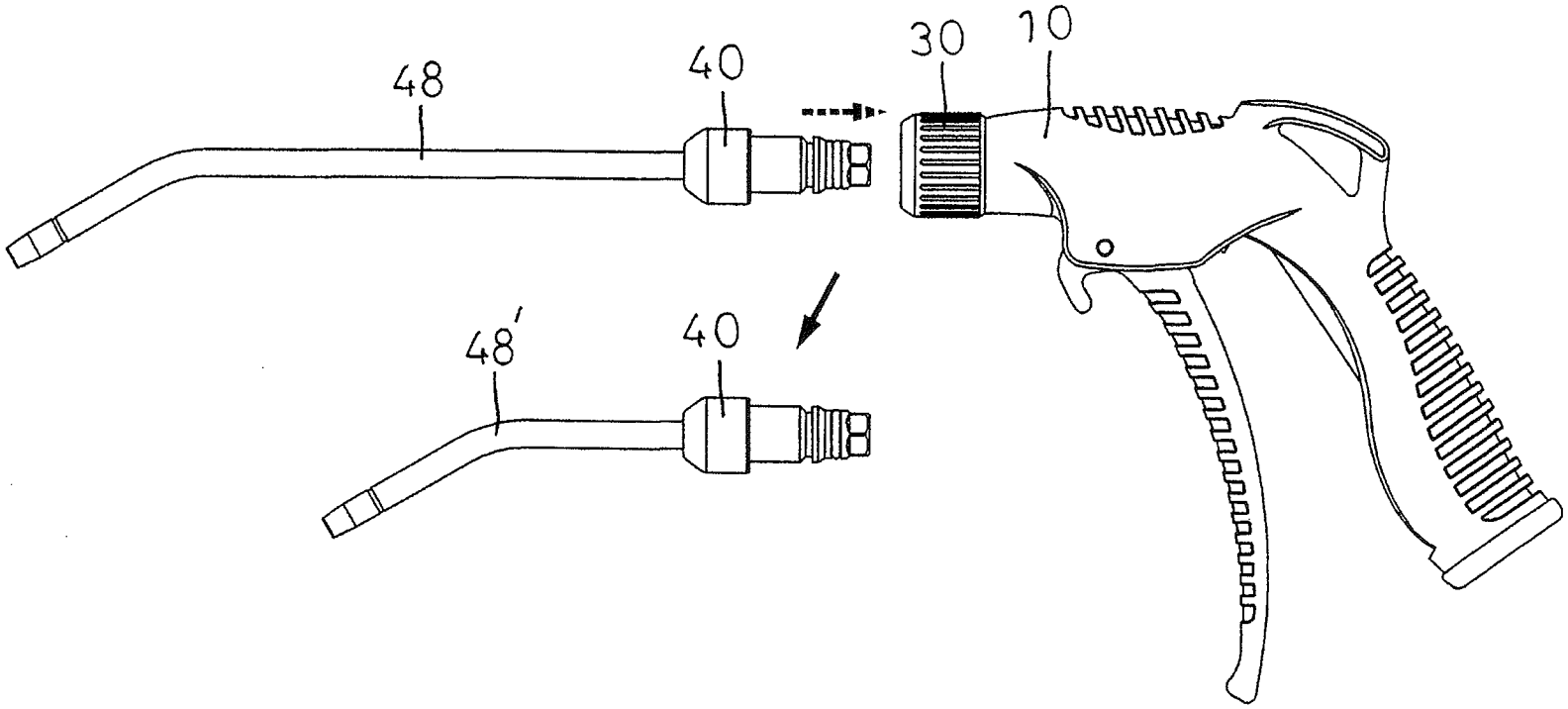
FIG. 11 is a schematic view showing usage of the air blow gun in accordance with the present invention.

In operation, referring to FIGS. 8-11 with reference to FIGS. 1-7, when the rotation knob 30 is rotated reversely, the clamping ring 20 is rotated in concert with the rotation knob 30, and the clamping jaws 23 of the clamping ring 20 are also rotated relative to the mounting head 12 of the gun body 10. When the two second oblique guide faces 26 of each of the clamping jaws 23 touch and press the two resting portions 16 of each of the two arcuate slots 14 as shown in FIG. 10, each of the clamping jaws 23 is pressed outward, and the clamping ring 20 is expanded outward, so that the clamping jaws 23 of the clamping ring 20 are released from the locking groove 44 of the nozzle head 40 as shown in FIG. 8, and the nozzle head 40 is unlocked from the clamping ring 20. Thus, the nozzle head 40 can be detached from the mounting head 12 of the gun body 10 for replacing the air outlet pipe 48. Preferably, the nozzle head 40 is provided with a second air outlet pipe 48' as shown in FIG. 11 having kinds and sizes different from that of the air outlet pipe 48.

Figure 13:
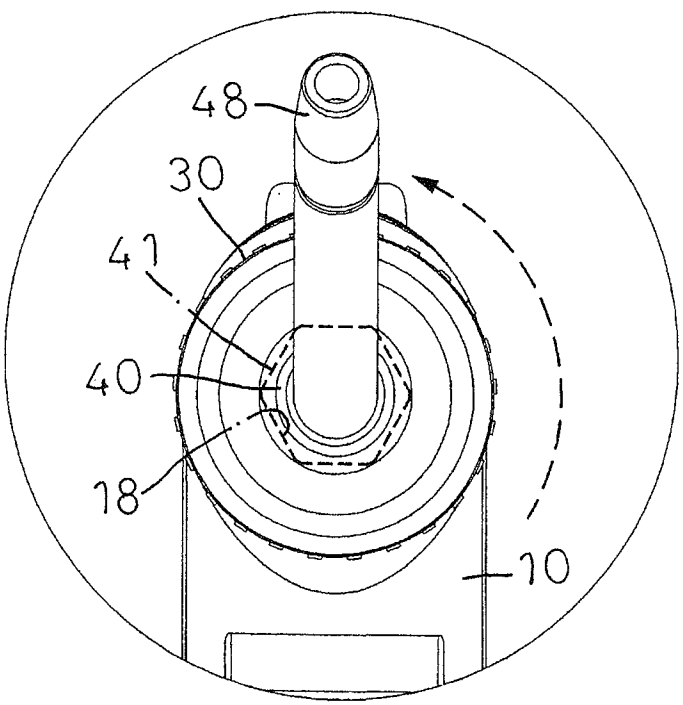
FIG. 13 is a schematic view showing adjustment of a second air outlet angle of the air blow gun in accordance with the preferred embodiment of the present invention.
Figure 12:
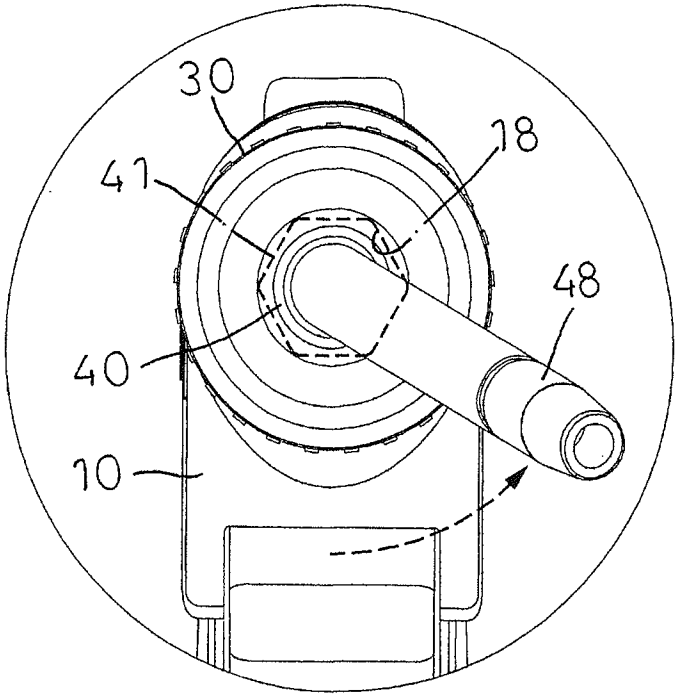
FIG. 12 is a schematic view showing adjustment of a first air outlet angle of the air blow gun in accordance with the preferred embodiment of the present invention.

Referring to FIGS. 12 and 13, the at least three second engaging portions 41 of the nozzle head 40 correspond to the at least three first engaging portions 18 of the gun body 10 at different positions so that the angle of the nozzle head 40 relative to the mounting head 12 of the gun body 10 can be adjusted so as to adjust the angle of the air outlet pipe 48.

Figure 15:
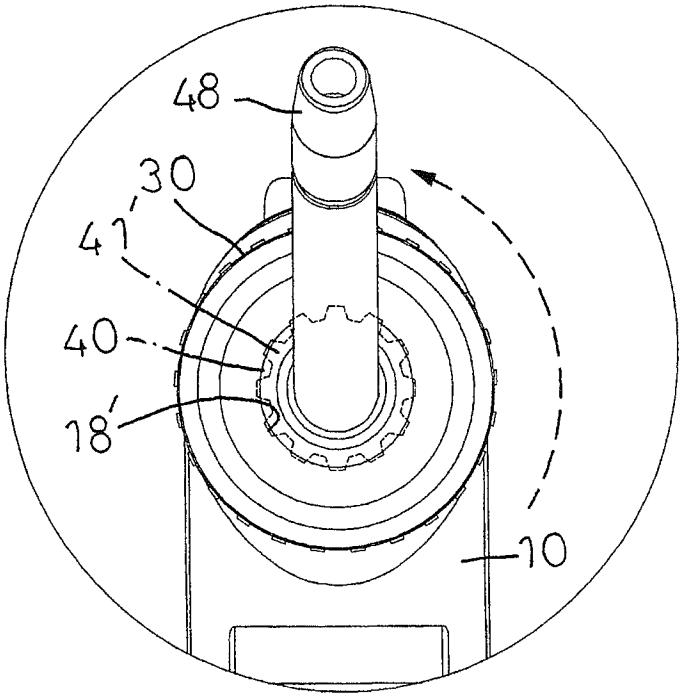
FIG. 15 is a schematic view showing adjustment of a second air outlet angle of the air blow gun in accordance with another preferred embodiment of the present invention.
Figure 14:
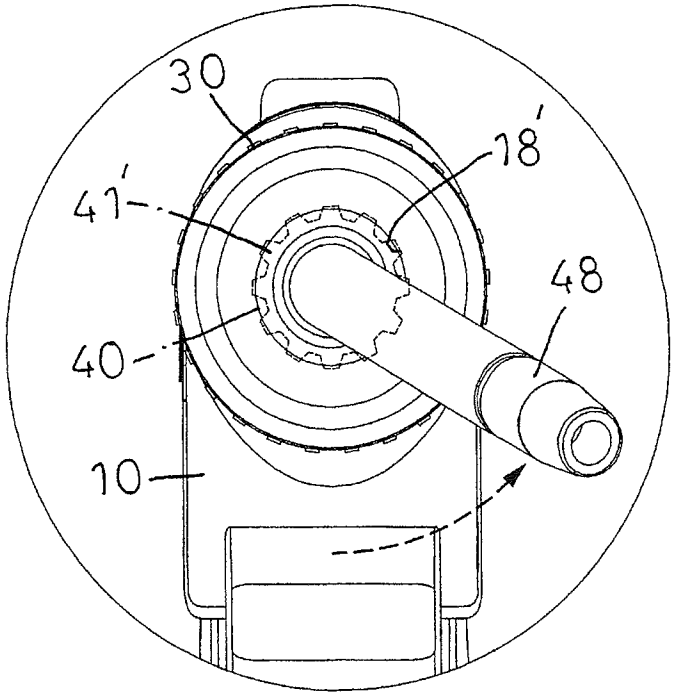
FIG. 14 is a schematic view showing adjustment of a first air outlet angle of the air blow gun in accordance with another preferred embodiment of the present invention.

Referring to FIGS. 14 and 15, the at least three first engaging portions 18' of the mounting head 12 of the gun body 10 form a plurality of inner ratchet teeth, and the at least three second engaging portions 41' of the nozzle head 40 form a plurality of outer ratchet teeth.

Accordingly, the nozzle head 40 is unlocked from the clamping ring 20 by rotating the rotation knob 30 so that the nozzle head 40 is detached from the mounting head 12 of the gun body 10 easily and quickly, thereby facilitating a user replacing the air outlet pipe 48.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A method for quickly replacing an air outlet pipe of an air blow gun, comprising:

providing a gun body, a clamping ring, a rotation knob, and a nozzle head;

wherein:

the gun body has an air outlet provided with a mounting head;

the nozzle head is inserted into the mounting head of the gun body;

the clamping ring is mounted on the mounting head of the gun body;

the rotation knob is mounted on the clamping ring;

the mounting head has a periphery provided with two arcuate slots;

each of the two arcuate slots is provided with two ramps forming two acute resting portions;

the clamping ring has a substantially C-shaped profile;

the clamping ring has a periphery provided with two substantially inverted U-shaped slits forming two elastic plates;

the two elastic plates form two clamping jaws respectively extending into the two arcuate slots of the mounting head;

each of the clamping jaws is provided with two oblique guide faces corresponding to the two resting portions of each of the two arcuate slots;

when the two oblique guide faces of each of the clamping jaws touch the two resting portions of each of the two arcuate slots, each of the clamping jaws is pressed outward;

the nozzle head has a front portion provided with an air outlet pipe;

the nozzle head is provided with an annular locking groove corresponding to the clamping jaws of the clamping ring; and the clamping jaws of the clamping ring are locked in the locking groove of the nozzle head by an elastic force of the two elastic plates;

the method further comprises:

rotating the rotation knob to rotate the clamping ring;

moving the two oblique guide faces of each of the clamping jaws of the clamping ring to touch the two resting portions of each of the two arcuate slots of the mounting head of the gun body;

pressing outward each of the clamping jaws of the clamping ring;

releasing the clamping jaws of the clamping ring from the locking groove of the nozzle head;

detaching the nozzle head from the clamping ring; and detaching the nozzle head from the mounting head of the gun body.

2. The method of claim 1, wherein the rotation knob together with the clamping ring is rotatable relative to the mounting head of the gun body through an angle of thirty degrees (30°) in a positive or reverse direction.

3. The method of claim 1, wherein the air outlet pipe of the nozzle head has different sizes and kinds.

4. The method of claim 1, wherein the mounting head has an interior provided with at least three first engaging portions, and the nozzle head has a rear portion provided with at least three second engaging portions engaging the at least three first engaging portions of the gun body so that the nozzle head is combined with the mounting head of the gun body.

5. The method of claim 4, wherein the at least three first engaging portions of the mounting head of the gun body form a hexagonal hole for mounting the nozzle head, and the at least three second engaging portions of the nozzle head form a hexagonal head.

6. The method of claim 4, wherein the at least three first engaging portions of the mounting head of the gun body form a plurality of inner ratchet teeth, and the at least three second engaging portions of the nozzle head form a plurality of outer ratchet teeth.

* * * * *